United States Patent [19]

Fujita et al.

[11] Patent Number: 4,600,378

[45] Date of Patent: Jul. 15, 1986

[54] STEEL STRIP HEATING FURNACE AND METHOD

[75] Inventors: Sadao Fujita; Akira Toyokawa; Shinichiro Mutoh; Eishu Shimomukai; Kenji Ueda, all of Chiba, Japan

[73] Assignee: Kawasaki Steel Corporation, Hyogo, Japan

[21] Appl. No.: 734,975

[22] Filed: May 16, 1985

[51] Int. Cl.[4] ..... F27B 9/28; C21D 9/52; F24J 3/00; F27D 3/00

[52] U.S. Cl. ..... 432/8; 266/102; 432/59; 432/226; 432/245; 432/249

[58] Field of Search ..... 432/8, 59, 226, 245, 432/249; 266/102, 103

[56] References Cited

U.S. PATENT DOCUMENTS

| | | | |
|---|---|---|---|
| 1,910,549 | 5/1933 | Junker | 432/8 |
| 2,983,493 | 5/1961 | Dailey, Jr. | 432/8 |
| 4,035,142 | 7/1977 | Hatzenbichler et al. | 432/245 |

*Primary Examiner*—John J. Camby
*Attorney, Agent, or Firm*—Austin R. Miller

[57] ABSTRACT

A steel strip heating furnace has a movable wall which can be positioned closer or farther away from the transverse edges of the steel in order to adjust the heat radiation applied to the opposing edges of the steel. The movable wall extends parallel to the longitudinal axis of a course along which the steel is transported through the furnace. The movable wall constitutes part of a ceiling of a furnace body and can be shifted vertically toward and away from the transverse edges of the steel so as to adjust the high-temperature heat radiation transmission area about the opposing transverse edge and thus control the heat applied to the corresponding section of the steel. Also, it is especially advantageous to provide means for cooling the movable wall so as to adjust the heat radiation therefrom. Therefore, the heating furnace can control the heat applied to the transverse edges of the steel so that the entire surface of the steel can be heated uniformly.

12 Claims, 6 Drawing Figures

STEEL STRIP HEATING FURNACE AND METHOD

BACKGROUND OF THE INVENTION

The present invention relates generally to a steel strip heating furnace for heating steel strips conveyed along a preset course. More particularly, the invention relates to a steel strip heating furnace which can eliminate the adverse influence of heat radiation.

The structure of a typical furnace 10 is shown in FIG. 1 in transverse section. The furnace 10 has a furnace body comprising a ceiling 12, a floor 14 and side walls 16 extending between the ceiling and the floor. The course for the steel strips 20 is defined within the furnace body by a skid beam 22 supported on the floor 14. A plurality of the steel strips 20 are mounted on the skid beam 22 transversely across the course, and forcibly transported along the course.

As they travel along the course, the steel strips 20 are heated by radiation from the furnace body. Therefore, the central section 20A of each steel strip 20 generally receives heat radiated by the ceiling 12 and the floor 14. On the other hand, the ends 20B of the steel strips are subject not only to heat from the ceiling 12 and floor 14 but also from the opposing side wall 16. Therefore, the end sections 20B receive more heat than the central section. This generates a thermal gradient between the central section 20A and the end sections 20B, and, as a result tends to heat the end sections 20B excessively. These thermal gradients generate deformation stresses between the end sections and the central section.

In view of the above defect, an improvement to this furnace, shown in FIG. 2 has been proposed. In the proposed improvement, an attempt has been made to reduce the effective heat radiation area by forming a recess in the side wall of the furnace opposite the transverse edges of the steel strip. The recess 18 is of depth ab (=cd) and width (bc) which are significantly smaller than the depth AB(=CD) and width (BC) of the corresponding area of the furnace of FIG. 1. Since the heating at the transverse ends of the steel strip is determined by effective heat radiation area (ab×bc×furnace length), the end heating can be moderated by reducing the effective heat radiation area (AB×BC×furnace length) of the furnace of FIG. 1.

However, even the improvement of FIG. 2 is not fully satisfactory in that it does not actually control the heat radiation applied to the transverse ends of the steel strip, but rather relies solely on geometry for even heating.

SUMMARY OF THE INVENTION

Therefore, it is an object of the present invention to provide a heating furnace for steel strips or plate which can uniformly heat the entire surface of the steel.

Another and more specific object of the invention is to provide a heating furnace which can adjust the heat applied to the transverse ends or edges of the steel in order to achieve even heating over the entire surface of the steel.

In order to accomplish the above-mentioned and other objects, a steel strip heating furnace, according to the inventin, has a movable wall which can be positioned closer or farther away from the transverse edges of the steel in order to adjust the heat radiation applied to the opposing edges of the steel. The movable wall extends parallel to the longitudinal axis of a course along which the steel is transported through the furnace.

Preferably, the movable wall constitutes part of a ceiling of a furnace body and can be shifted vertically toward and away from the transverse edges of the steel so as to adjust the high-temperature heat radiation transmission area about the opposing transverse edge and thus control the heat applied to the corresponding section of the steel. Also, it is especially advantageous to provide means for cooling the movable wall so as to adjust the heat radiation therefrom.

Therefore, the heating furnace, according to the present invention, can control the heat applied to the transverse edges of the steel so that the entire surface of the steel can be heated uniformly.

According to one aspect of the invention, a heating furnace for heating steel strip comprises a furnace body defining an enclosed heating space therein, the furnace body including a longitudinal side wall, means for conveying the steel along a preset course through the furnace body, a movable wall extending along at least part of the longitudinal length of the course and having a section interfering with heat radiation from furnace body toward an end section of the steel nearest the side wall, and an actuator associated with the movable wall for moving the latter toward and away from the end section of the steel strip.

According to another aspect of the invention, a process for heating steel strips comprises the steps of:

feeding a plurality of steel strips along a preset course;

heating walls of a furnace surrounding the course so as to heat the steel strips by radiation from the walls;

providing a movable wall opposing the transverse end sections of the steel strips on opposite sides of the axis of travel thereof, which movable wall extends essentially parallel to and overlapping at least a part of the entire length of the course; and positioning the movable wall relative to the transverse end section of the steel strips so as to control heat transmission from the walls of the furnace to the transverse end section of the steel strip.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
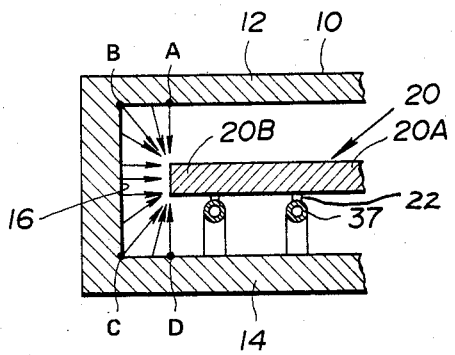
FIG. 1 (PRIOR ART)
FIGS. 1 and 2, as explained above, are cross-sections through major parts of conventional furnaces.
Figure 2:
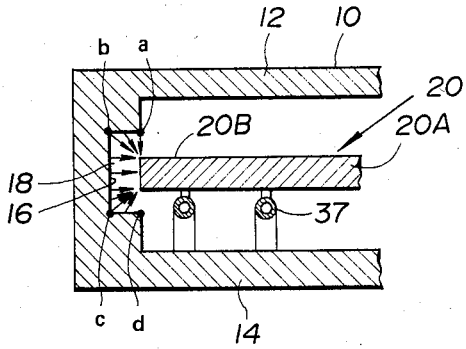
FIG. 2 (PRIOR ART)
Figure 3:
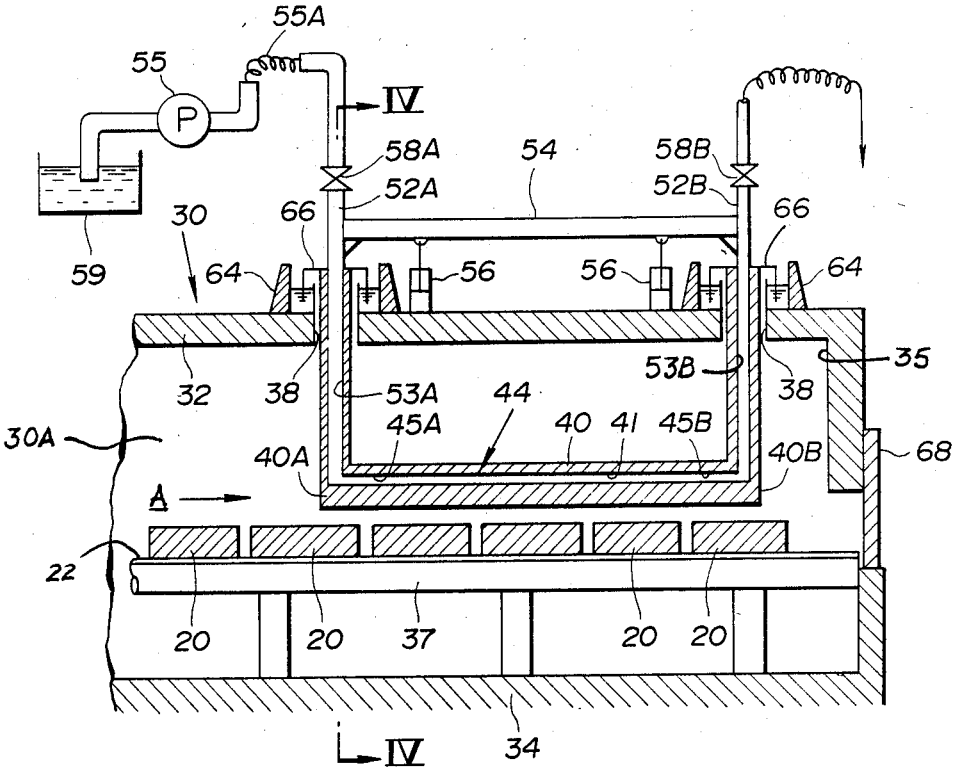
FIG. 3 is a longitudinal section through a heating furnace in accordance with the preferred embodiment of the present invention.
Figure 4:
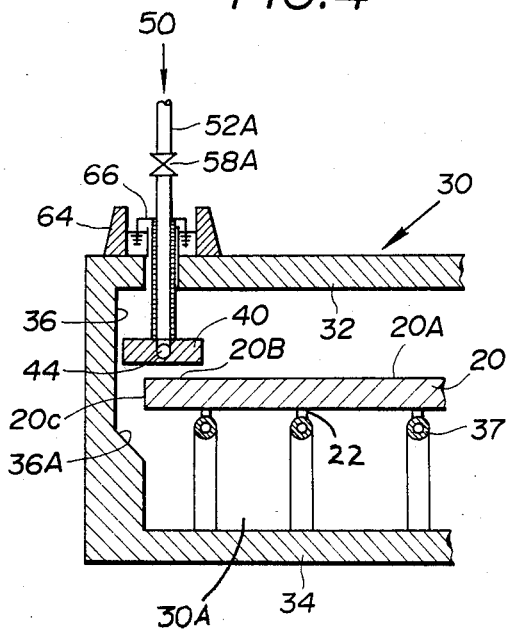
FIG. 4 is a cross-section through the heating furnace taken along line IV—IV of FIG. 3.

Referring now to the drawings, particularly to FIGS. 3 and 4, a furnace body 30 generally comprises the ceiling 32, the floor 34 and side walls 36 extending between the ceiling and the floor. The furnace body 30 defines a heating chamber 30A for heating a plurality of steel strips 20 transported or conveyed along a preset course A. A plurality of skid beams 37 supported by the floor 34 extend longitudinally along the furnace body 30. The skid beams 37 define the course through the furnace. As in the prior art, the steel strips are mounted sideways on the skid beams so that their longitudinal ends 20C oppose the side walls 36, which longitudinal ends will be referred to hereafter as "transverse edges". The sections 20B of the steel strips surrounding the transverse edges 20C will be referred to hereafter as "transverse end sections".

Vertically extending end walls 35 also extends between the ceiling 32 and the floor 34 and form part of the furnace body 30. The vertical wall 35 located at a downstream portion of the course A is formed with an outlet 68 through which the heated metal strips 20 are taken out.

A movable wall 40 opposes each of the transverse end sections 20B. The movable wall 40 extends along the side wall 36 parallel to the transverse end section 20B of the steel strip 20, as shown in FIG. 4. The movable wall 40 is suspended from the ceiling 32 by means of a hanger mechanism 50. The hanger mechanism 50 comprises vertical hanger pipes 52A and 52B at the opposite longitudinal ends 40A and 40B of the movable heating wall 40. The hanger pipes 52A and 52B pass through openings 38 in the ceiling 32 of the furnace body 30 and are connected to each other by a horizontal beam 54. The horizontal beam 54 is connected to a pair of actuators 56 such as hydraulic cylinders which can be operated manually or automatically to raise and lower the horizontal beam 54 and the movable wall 40 toward and away from the transverse end section 20B of the steel strip 20.

If necessary, the actuators 56 may be associated with a controller to control the operation thereof. The controller may control the actuator operation and whereby control the height of the movable wall 40. The controller may also be associated with a heating condition sensor for detecting heating condition of the steel strips in the furnace on the basis of the condition detecting by the sensor. This may ensure uniformity of heating over the entire sorrounding of the steel strip.

Figure 5:
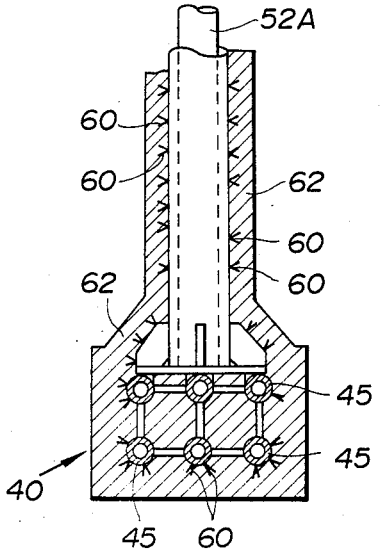
FIG. 5 is an enlarged section through a movable wall employed in the preferred embodiment of the heating furnace of FIG. 3.

The hanger pipes 52A and 52B are hollow cylindrical pipes serving as cooling water conduits with passages 53A and 53B. The cooling water passages 53A and 53B communicate with cooling water passages formed in the movable wall 40. As shown in FIG. 5, the cooling passage in the movable wall 40, which is generally referred to by the reference numeral "41", comprises a plurality of, e.g. six, hollow pipes 45 each connected to the cooling passages 53A and 53B through galleries (not shown). The cooling water passages 53A, 53B and 41 form a complete cooling water circuit 44.

Flow control valves 58A and 58B installed in the cooling water passages 53A and 53B control the cooling water flow rate through the cooling water circuit. The flow control valves 58A and 58B can be controlled manually or automatically so as to adjust the cooling water flow through the cooling water circuit in accordance with the heating conditions of the movable wall.

The cooling water passage 53A is connected to a fluid pump 55 which draws cooling water from a cooling water reservoir 59 for circulation through the cooling water circuit 44. The cooling water passage 44 is connected to the cooling water reservoir 59 at one end and to a return line (not shown) at the other end via flexible hoses 55A.

The pipes 45A forming the cooling water passage 45 within the movable wall 40 are anchored within a matrix of fireproof material 62 forming the movable wall 40. Also, the lower section of the hanger pipes 52A and 52B are anchored within the fireproof material 62 surrounding the lower ends of the hanger pipes.

The flow control valve and the fluid pump may control the operations manually or automatically in per se well known manner in accordance with the heating condition in the furnace. By controlling the flow control valves and the fluid pump, flow rate of the cooling water can be varied for varying cooling effect for the movable wall 40.

Water-tight traps 64 with metal water seals 66 encircle both openings 38 in the ceiling 32 through which the hanger pipes 52A and 52B pass. The water-tight traps 64 and metal water seals 66 seal the furnace against water leakage.

With the furnace construction according to the preferred embodiment as set forth above, the operation is as follows:

The steel strips 20 enter the heating furnace from the upstream end of the course A. The steel strips are layed across the skid beams 37 so that their longitudinal end sections 20B oppose the side walls 36.

The actuators 56 are operated to place the movable wall 40 near the transverse end section 20B of the steel strip. At the same time, the fluid pump 55 starts to circulate the cooling water through the cooling water circuit 44.

The strips 20 are heated by radiation from the ceiling 32, the floor 34 and the side walls 36. The movable wall 40 interferes with transmission of heat radiated toward the transverse end sections 20B of the steel. Therefore, the effective heat transmission area adjoining the transverse end sections 20B is smaller than in conventional furnaces.

Figure 6:
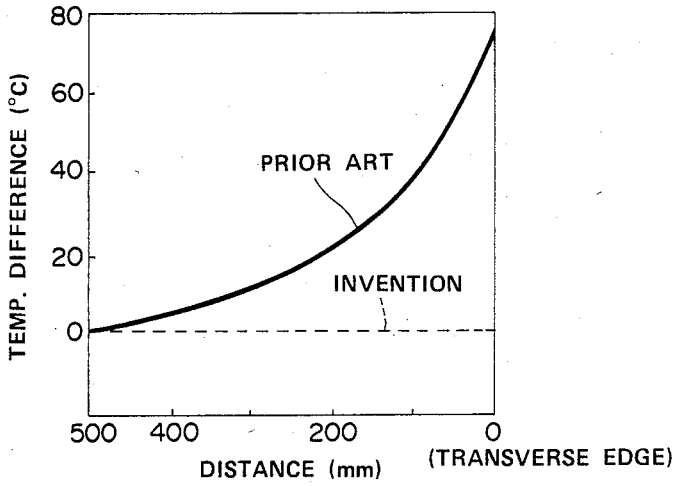
FIG. 6 is a graph of the relationship between the temperature gradient and distance across the steel strip.

FIG. 6 shows the results of experiments designed to measure the temperature difference between the transverse end section 20B and the central section 20A. As is apparent herefrom, in conventional furnaces (as shown in solid line), the temperature difference between the end section 20B and the central section 20A can be as high as approximately 80° C. This contrasts sharply with the results for the inventive furnace shown in broken line in FIG. 6. In this case, there is almost no temperature difference between the end section 20B and the central section 20A. In other words, the steel strip can be heated evenly over its entire surface.

According to the shown embodiment, since the movable wall can be cooled by circulating cooling water through the cooling water circuit 44, the surface temperature of the movable wall can be held low enough to significantly influence the heating conditions at the transverse end section 20B.

In addition, according to the shown embodiment, the thickened lower section of the side wall 36A narrows the clearance between the transverse edge 20C of the steel strip 20 and the inner periphery of the side wall 36.

This suppresses convection of gaseous combustion products between the lower combustion zone and the upper combustion zone in order to reduce convection heating.

It should be noted that although the thicker side wall 36A (FIG. 4) will help reduce convection of combustion product and thus reduce convection heating, it is not a necessary aspect of the invention. In cases where the heat isolation due to the movable wall 40 is sufficient, the side wall can be of sheer configuration. On the other hand, the fluid circulating through the cooling water circuit 44 need not necessarily be water. It can be replaced with any suitable cooling fluid.

Furthermore, although hydraulic cylinders have been shown for actuating the movable wall relative to the transverse end section 20B of the steel strip 20, they may be replaced by any suitable actuating system.

As will be appreciated herefrom, according to the present invention, heat can be applied uniformly over the entire surface of the steel strips for even heating. This prevents the generation of uneven deformation stresses across the steel strip. As a result, the steel strip can be rolled and/or forged to an even thickness and width.

Therefore, the present invention satisfactorily and successfully fulfills all of the objects and advantages sought therefor.

What is claimed is:

1. A heating furnace for flat steel products comprising:

a furnace body defining an enclosed heating space therein, said furnace body including a longitudinally extending heat-radiating side wall;

means for conveying the steel along a preset course through the furnace body with portions of said steel exposed to radiation from said side wall;

a movable wall extending along at least part of the length of said course and having a body portion movable toward and away from said portion of said side wall;

a cooling system incorporated into said movable wall for cooling said movable wall, said cooling system including means providing a cooling fluid path extending through said movable wall and means for connecting said cooling fluid path to a cooling fluid source, and said cooling system further including a flow control means which is connected to control the cooling fluid flow rate through said cooling fluid path; and an actuator associated with said movable wall for moving the latter toward and away from said end portion of said steel.

2. The furnace as set forth in claim 1, wherein said movable wall is suspended from the ceiling of said furnace body and vertically movable toward and away from said end section of said steel.

3. The furnace as set forth in claim 2, wherein said movable wall is associated with a hanger mechanism which is driven vertically by means of said actuator.

4. The furnace as set forth in claim 1, wherein the lower section of said longitudinal side wall of said furnace body lies closer to the end section of said steel so as to suppress convection between a lower combustion zone and an upper combustion zone in said furnace body.

5. The furnace as set forth in claim 1, wherein a lower section of a side wall of said furnace is thicker than an upper section of said side wall so as to reduce clearances around the transverse edges of said steel strips and so suppress convection within the furnace.

6. The furnace as set forth in claim 1, wherein said cooling path comprises a plurality of pipes extending through said movable wall in essentially a parallel relationship to each other.

7. The furnace as set forth in claim 6, wherein said plurality of pipes are arranged in matrix form.

8. The furnace as set forth in claim 7, wherein each of said pipes is anchored within the matrix of a fireproof material which forms said movable wall.

9. The furnace as set forth in claim 8, wherein said actuator comprises hanger pipe defining therethrough a cooling fluid passage connecting said cooling fluid source and each of said pipes.

10. A heating furnace for steel comprising:

a furnace body defining an enclosed heating space therein, said furnace body including a longitudinally extending side wall;

means for conveying the steel along a preset course through said furnace body and adjacent to said side wall;

a movable wall extending along at least part of the length of said course and positioned adjacent the end portions of said steel nearest said side wall;

a cooling system incorporated into said movable wall and including a plurality of passageways arranged in matrix and extending longitudinally through said movable wall for cooling the latter, each of said passageways being connected to a cooling fluid source; and an actuator associated with said movable wall for moving the latter toward and away from said end portions of said steel.

11. A process for heating steel strip comprising the steps of:

providing a course along which said steel strip travels in a heating furnace;

feeding a plurality of steel strips along said course;

heating walls of a furnace surrounding said course so as to heat said steel strips by radiation from said walls;

providing a movable wall adjacent to the transverse end sections of said steel strips on opposite sides of the axis of travel thereof, which movable wall extends essentially parallel to and overlapping at least a part of the entire length of said course;

providing a cooling system in said movable wall, which cooling system comprises a plurality of cooling paths extending longitudinally and essentially in parallel to each other in matrix fashion; and positioning said movable wall relative to said transverse end sections of the steel strips so as to control heat transmission from said walls of the furnace to said transverse end sections of said steel strips.

12. The process as set forth in claim 11, which further comprises a step of circulating a cooling fluid through said movable wall for cooling the latter.

* * * * *